US006835112B2

(12) United States Patent
Tanabe et al.

(10) Patent No.: US 6,835,112 B2
(45) Date of Patent: Dec. 28, 2004

(54) ELECTROLUMINESCENT LAMP AND METHOD FOR MANUFACTURING THE SAME

(75) Inventors: Koji Tanabe, Osaka (JP); Akito Kawasumi, Osaka (JP); Shinji Okuma, Fukui (JP); Yosuke Chikahisa, Hyogo (JP); Naohiro Nishioka, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/095,104

(22) Filed: Mar. 12, 2002

(65) Prior Publication Data

US 2002/0145383 A1 Oct. 10, 2002

(30) Foreign Application Priority Data

Mar. 19, 2001 (JP) ..... 2001-077863
Oct. 1, 2001 (JP) ..... 2001-305035
Dec. 5, 2001 (JP) ..... 2001-371250

(51) Int. Cl.[7] ..... H01J 9/00
(52) U.S. Cl. ..... 445/50; 445/49
(58) Field of Search ..... 445/24, 25, 50, 445/51; 313/504, 502, 506; 427/65, 2

(56) References Cited

U.S. PATENT DOCUMENTS 4,289,799 A * 9/1981 Sarvas ..... 427/65
4,902,567 A * 2/1990 Eilersten et al. ..... 313/506
5,598,067 A 1/1997 Vincent et al.

FOREIGN PATENT DOCUMENTS

| | | | |
|---|---|---|---|
| EP | 0 323 218 | A1 | 7/1989 |
| JP | 4-36993 | A | 2/1992 |
| JP | 8-148278 | A | 10/1996 |
| JP | 2001-284053 | A | 10/2001 |
| WO | WO 88/04467 | A | 6/1988 |
| WO | WO 00/42825 | A | 7/2000 |

* cited by examiner

*Primary Examiner*—Joseph Williams
(74) *Attorney, Agent, or Firm*—McDermott Will & Emery LLP

(57) ABSTRACT

An electroluminescent lamp (EL lamp) is formed by stacking a light-transmitting electrode-layer, an adhesive synthetic resin layer, a luminescent layer formed of the synthetic resin layer with phosphor particles fixed uniformly, a dielectric layer and a back electrode-layer on a transparent substrate sequentially. By this structure, a uniform EL lamp having improved brightness can be produced. A method for manufacturing the EL lamp includes following steps for fixing the phosphor particles in the synthetic resin layer uniformly. (1) sinking the phosphor particles in the synthetic resin layer by heating and pressing, after spraying the phosphor particles. (2) blowing the phosphor particles to the synthetic resin layer with heated air. As a result, the phosphor particles are uniformly fixed in the synthetic resin layer having uniform thickness.

11 Claims, 6 Drawing Sheets

200μm

ELECTROLUMINESCENT LAMP AND METHOD FOR MANUFACTURING THE SAME

FIELD OF THE INVENTION

Recently, multifunction and diversification of an electronic apparatus (particularly a portable terminal device, e.g., a cellular phone) have progressed, so that electroluminescent lamp (EL lamp) is used for illuminating a display area or an operating section of the apparatus.

BACKGROUND OF THE INVENTION

A conventional electroluminescent lamp (EL lamp) will be described with reference to FIG. 6.

FIG. 6 shows a sectional view of the conventional EL lamp. As shown in FIG. 6, light-transmitting electrode-layer 52, e.g., indium tin oxide, is formed on a whole surface of transparent substrate 51, e.g., a glass or a film, using a sputtering method or an electron beam method.

The conventional EL lamp is formed by the following elements:

(a) luminescent layer 53 formed of the synthetic resin layer 53A in which phosphor particles 53B, e.g., zinc sulfide, (base material of luminescence) disperse, and formed on transparent substrate 51, (b) dielectric layer 54 made of synthetic resin, where barium titanate disperses, and formed on luminescent layer 53, (c) back electrode-layer 55 made of silver or carbon resin, and formed on dielectric layer 54, and (d) insulating layer 56 made of epoxy resin or polyester resin and formed on back electrode-layer 55.

The EL lamp mentioned above is installed in an electronic apparatus, and an AC voltage is applied between light-transmitting electrode-layer 52 and back electrode-layer 55. As a result, phosphor particle 53B of luminescent layer 53 emits light, and the light illuminates a display area or an operating section of the electronic apparatus from behind.

Luminescent layer 53 is formed by the following method. First, paste is made of cyano resin or fluororubber dissolved in organic solvent. Second, phosphor particles 53B disperse in the paste. Third, the paste is formed by a reverse-roll coater or a die coater, or printed by a screen printing. Finally, the paste is dried and formed. By the coating method using the reverse-roll coater or the die coater, phosphor particles 53B can be dispersed in luminescent layer 53 uniformly to a certain extent by changing composition of phosphor particles 53B in the paste or thickness of the coating paste. By this coating method, the luminescent layer can coat on the whole surface of a rectangular substrate, however, can not coat the surface in a specific pattern.

When the specific pattern is required, the screen printing is usually used for forming luminescent layer 53. A screen mask used for the screen printing is made of sheet which is formed by knitting stainless threads or polyester threads of diameter approximately 30 $\mu$m. The sheet is formed of opening-sections into which paste penetrates and closed-sections into which paste does not penetrate, so that a pattern of an electrode can be printed. As shown in FIG. 6, because the sheet is formed by knitting threads, area 53C under the threads or under intersections of the threads printed with phosphor particles 53B insufficiently or not printed tends to occur.

A mean diameter of phosphor particles 53B is approximately 20 $\mu$m through 25 $\mu$m. As shown in FIG. 6, when phosphor particles 53B are printed using a screen mask of thickness 60 $\mu$m, two or three of phosphor particles 53B tends to pile up at an area 53D under the opening-section.

In the conventional EL lamp discussed above, phosphor particles 53B are difficult to disperse in luminescent layer 53 uniformly, so that an area on which phosphor particles 53B do not disperse or pile up tends to occur. As a result, light emission from phosphor particles 53B tends to produce uneven brightness.

When luminescent layer 53 is formed of paste, which is made of synthetic resin dissolved in organic solvent, and phosphor particles 53B disperse in the resin, a state of dispersing phosphor particles 53B tends to disperse unevenly even in the same printing condition. Because characteristics of printing is changed by diameters or shapes of phosphor particles 53B, or changed by a surface shape of light-transmitting electrode-layer 52.

SUMMARY OF THE INVENTION

The present invention addresses the problem discussed above, and aims to provide an electroluminescent lamp (EL lamp), of which brightness uniformity is improved, and provide a method for manufacturing the EL lamp.

The EL lamp of this invention includes the following elements:

(a) a transparent substrate, (b) a light-transmitting electrode-layer formed on the transparent substrate, (c) an adhesive synthetic resin layer formed on the light-transmitting electrode-layer, (d) a luminescent layer which is formed of the synthetic resin layer with phosphor particles dispersed uniformly, (e) a dielectric layer formed on the luminescent layer, (d) a back electrode-layer formed on the dielectric layer.

Each phosphor particle disperses on the synthetic resin layer uniformly, and the luminescent layer is thus formed, so that the EL lamp having improved brightness uniformity is obtainable. Because a voltage is applied to the luminescent layer uniformly, an inexpensive and uniform EL lamp with high brightness using less phosphor particles is obtainable.

The method for manufacturing the EL lamp includes the following steps:

(a) forming a light-transmitting electrode-layer on a transparent substrate, (b) forming an adhesive synthetic resin layer on the light-transmitting electrode-layer, (c) sticking phosphor particles on the synthetic resin layer uniformly so that a luminescent layer is formed, (d) forming a dielectric layer on the luminescent layer, and (e) forming a back electrode-layer on the dielectric layer.

As a result, an inexpensive and uniform EL lamp having improved brightness can be produced.

DESCRIPTION OF THE PREFERRED EMBODIMENTS

Exemplary embodiments of the present invention are demonstrated hereinafter with reference to FIG. 1 through FIG. 4.

First Embodiment

Figure 1:
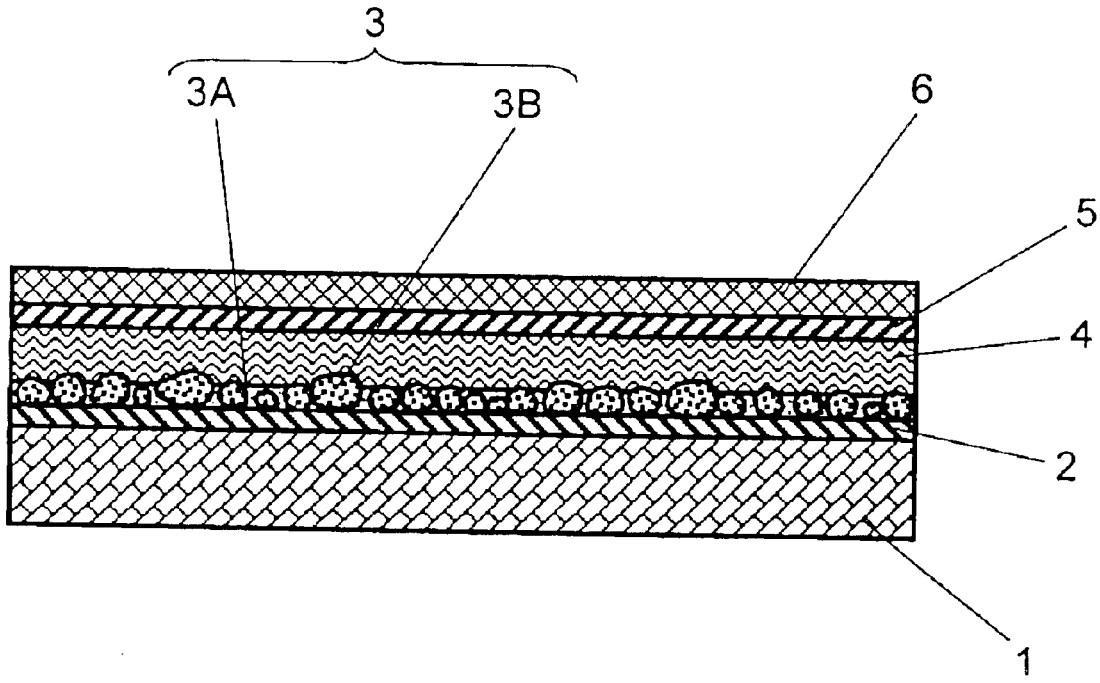
FIG. 1 shows a sectional view of an essential part of an electroluminescent lamp (EL lamp) in accordance with a first exemplary embodiment of the present invention.

FIG. 1 shows a sectional view of an essential part of an electroluminescent lamp (EL lamp) in accordance with the first exemplary embodiment of the present invention.

As shown in FIG. 1, the EL lamp is formed by the following elements:

(a) transparent substrate 1 made of glass, resin film, synthetic resin and the like, (b) light-transmitting electrode-layer 2 formed on transparent substrate 1, (c) luminescent layer 3 formed of adhesive synthetic resin layer 3A where phosphor particles 3B, e.g., zinc sulfide, disperse uniformly, and formed on light-transmitting electrode-layer 2, (d) dielectric layer 4 made of synthetic resin, where barium titanate and so on disperses, and formed on luminescent layer 3, (e) back electrode-layer 5 made of silver or carbon resin and formed on dielectric layer 4, and (f) insulating layer 6 made of epoxy resin or polyester resin and formed on back electrode-layer 5.

Light-transmitting electrode-layer 2 is formed by one of the following methods. One method is depositing indium tin oxide by using a sputtering method or an electron beam method, and another method is printing transparent synthetic resin where indium tin oxide disperses.

The EL lamp is installed in an electronic apparatus, and an AC voltage is applied between light-transmitting electrode-layer 2 and back electrode-layer 5 from a circuit of the electronic apparatus (not shown). As a result, phosphor particles 3B of luminescent layer 3 emit light, and the light illuminates a display area or an operating section of the electronic apparatus from behind.

In this embodiment, luminescent layer 3 is formed by uniformly dispersing phosphor particles 3B on synthetic resin layer 3A, so that the EL lamp having improved brightness uniformity is obtainable. As a result, because a voltage is applied to luminescent layer 3 uniformly, an inexpensive EL lamp with high brightness using less phosphor particles 3B is obtainable.

Luminescent layer 3 is formed as follows. Phosphor particles 3B disperse on a surface of synthetic resin layer 3A, then layer 3A is heated and pressed, so that phosphor particles 3B sink in layer 3A.

Synthetic resin not adhesive at a room temperature can be used as synthetic resin layer 3A, so that transparent substrates 1 having layer 3A can be stacked for a storage purpose. This storage allows the manufacturing of the EL lamp to be flexible.

A diameter of phosphor particles 3B can be greater than a thickness of synthetic resin layer 3A. In such a case, when transparent substrates 1 having layer 3A are stacked for a storage purpose, non-adhesive phosphor particles 3B come in contact with transparent substrates 1, so that transparent substrates 1 is easy to be stored.

Cyano resin, fluororubber, polyester resin or phenoxy resin can be used as a principal ingredient of synthetic resin layer 3A, whereby a dielectric constant of synthetic resin layer 3A becomes large, and brightness of an EL lamp thus becomes high.

In general, lifetime of luminescence becomes longer as a diameter of phosphor particle 3B becomes larger. In this invention, a diameter of 25 $\mu$m through 90 $\mu$m of phosphor particle 3B is applicable, so that lifetime of the EL lamp of this invention becomes longer than that of a conventional EL lamp having a phosphor particle of which diameter is 20 $\mu$m through 25 $\mu$m.

When thickness of synthetic resin layer 3A is 0.01 $\mu$m through 50 $\mu$m, and thinner than a diameter of phosphor particle 3B, a brighter EL lamp can be obtained.

Second Embodiment

Figure 2A:
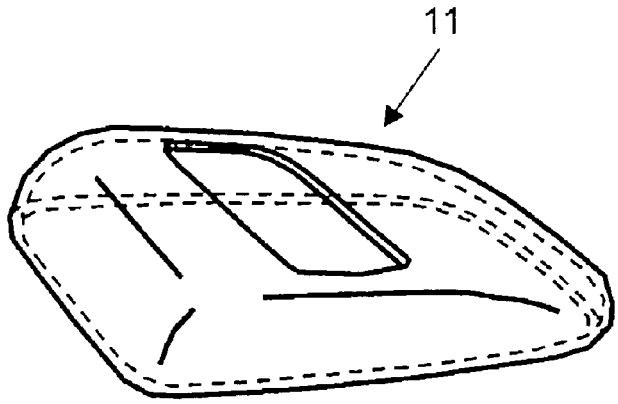
FIG. 2A shows an outward appearance of an EL lamp in accordance with a second exemplary embodiment of the present invention.
Figure 2B:
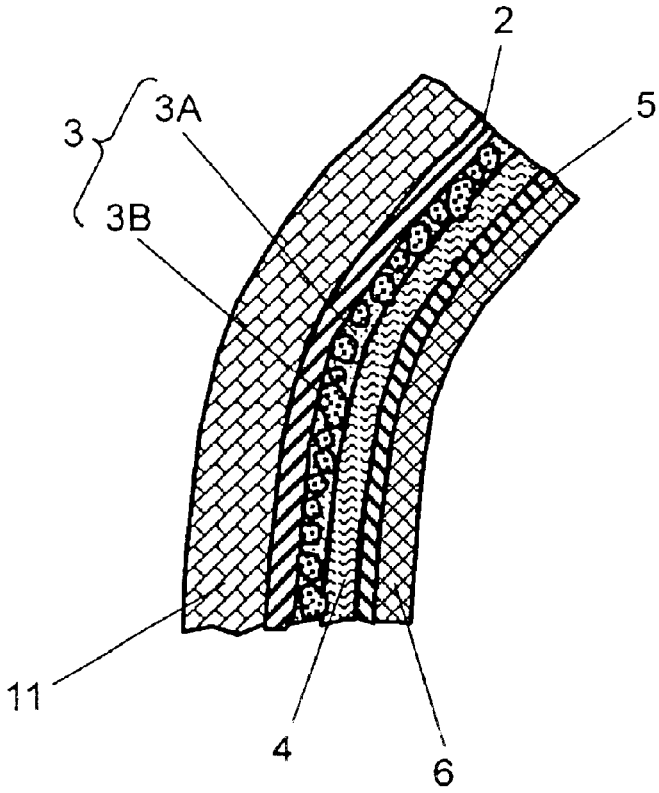
FIG. 2B shows a sectional view of an essential part of the EL lamp in accordance with the second embodiment of the present invention.

FIG. 2A shows an outward appearance of an electroluminescent lamp (EL lamp) in accordance with the second exemplary embodiment of the present invention. FIG. 2B shows a sectional view of an essential part of the same EL lamp.

As shown in FIG. 2A, for example, the El lamp included in an electronic apparatus is formed of transparent substrate 11 and a luminescent section. Transparent substrate 11 made of synthetic resin, e.g., polycarbonate, is molded into a curved-surface substrate, and the luminescent section is formed inside transparent substrate 11.

The luminescent section is detailed hereinafter with reference to FIG. 2B.

First, paste is sprayed on an inner surface of transparent substrate 11. The paste is made of epoxy resin (bis-phenol A liquid resin) of 98 wt % and imidazole hardening-agent (2E4MZ manufactured by Shikoku Corporation) of 7 wt % where transparent conductive particles of 400 wt % (SP-X manufactured by Sumitomo Metal Industries, Ltd.) disperse. Then, the paste hardens at 80° C. for 3 hours, light-transmitting electrode-layer 2 is thus formed.

Second, resin solution (isophorone solution where Daieru G502 manufactured by Daikin Industries, Ltd. is dissolved) is sprayed on light-transmitting electrode-layer 2, and then dried up, synthetic resin layer 3A is thus formed.

Third, phosphor particles 3B are sprayed on a surface of synthetic resin layer 3A at 80° C. using an air-spray gun, luminescent layer 3 is thus formed.

Then, paste is sprayed on luminescent layer 3, where the paste is made of resin solution (isophorone solution where Daieru G502 manufactured by Daikin Industries, Ltd. is dissolved) of resin component 40 wt % where barium titanate (BT-01 manufactured by Kanto Kagaku Kabushiki Kaisha) of 60 wt % disperses. Then the paste is dried up, dielectric layer 4 is thus formed.

The paste of dielectric layer 4 is sprayed approximately 5 $\mu$m in thickness at one time, and dried. This process is repeated three times, phosphor particles 3B are thus buried in synthetic resin layer 3A.

Next, the same paste as light-transmitting electrode-layer 2 is sprayed on dielectric layer 4, and hardens at 80° C. for 3 hours, back electrode-layer 5 is thus formed.

Finally, transparent polyester resin is sprayed on back electrode-layer 5, insulating layer 6 is thus formed, so that the EL lamp is constructed.

The EL lamp is installed in the electronic apparatus, and an AC voltage is applied between light-transmitting electrode-layer 2 and back electrode-layer 5 from a circuit of the electronic apparatus (not shown). Then, phosphor particles 3B of luminescent layer 3 emit light, and the light illuminates transparent substrate 11 from inside.

In this embodiment, respective layers are formed on transparent substrate 11 having a curved-surface, and the EL lamp is formed. As a result, the EL lamp, which can emit light depending on various shapes of display area or an operating section of the electronic apparatus, can be obtained.

Third Embodiment

FIGS. 3A through 3D show sectional views illustrating a method for manufacturing an electroluminescent lamp (EL lamp) in accordance with the third exemplary embodiment of the present invention.

Figure 3A:
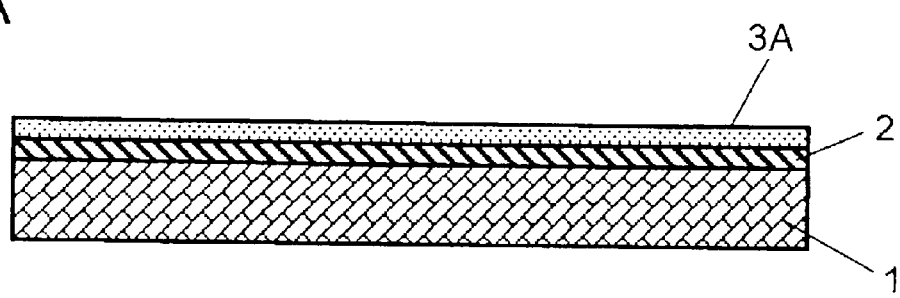
FIGS. 3A through 3D show sectional views illustrating a method for manufacturing an EL lamp in accordance with a third exemplary embodiment of the present invention.

First, as shown in FIG. 3A, light-transmitting electrode-layer 2 is formed on transparent substrate 1, and synthetic resin layer 3A is printed on light-transmitting electrode-layer 2. Cyano resin, fluororubber, polyester resin or phenoxy resin is used as material of synthetic resin layer 3A. Because a dielectric constant of resin of luminescent layer 3 is required large enough for obtaining high brightness of the EL lamp, cyano resin or fluororubber is desired to have a large dielectric constant.

The resin discussed above is dissolved in organic solvent, and printed using a screen printing method and dried, then synthetic resin layer 3A is formed. In the manufacturing of the EL lamp, because transparent substrate 1 having synthetic resin layer 3A is piled up for a storage purpose, the synthetic resin having no adhesion is easier to handle than the synthetic resin having adhesion. If fluororubber, e.g., Daieru G502 manufactured by Daikin Industries, Ltd., having adhesion at a room temperature is used, inorganic particles or solid resin particles, of which diameters or composition are determined based on a glass transition point or a coefficient of elasticity, are dispersed in the fluororubber. As a result, synthetic resin layer 3A, which does not have adhesion at a room temperature but gains adhesion by heating, is obtainable.

Figure 3B:
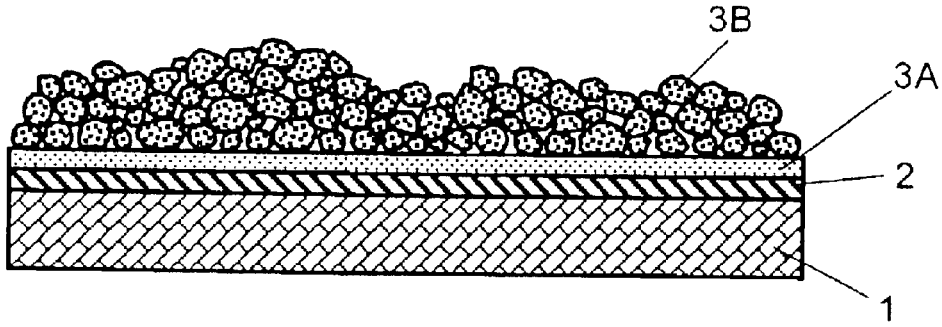

Second, as shown in FIG. 3B, phosphor particles 3B disperse on synthetic resin layer 3A.

Figure 3C:
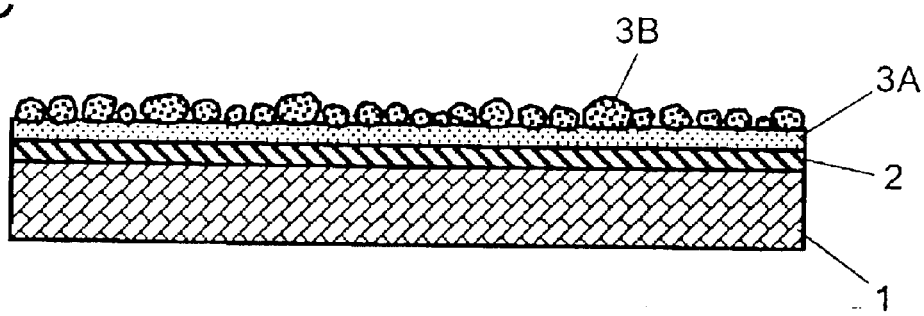

Third, as shown in FIG. 3C, synthetic resin layer 3A is heated, then obtains adhesion, so that phosphor particles 3B are fixed uniformly on a surface of synthetic resin layer 3A. Then phosphor particles 3B not fixed on the surface of synthetic resin layer 3A are removed.

Figure 3D:
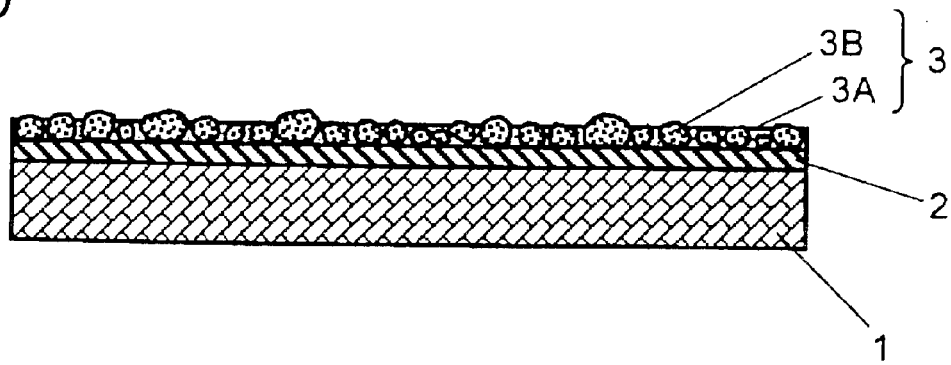

Then phosphor particles 3B are pressed using a rubber roller with synthetic resin layer 3A heated. As a result, phosphor particles 3B disperse uniformly in synthetic resin layer 3A, luminescent layer 3 shown in FIG. 3D is thus formed.

Finally, dielectric layer 4, back electrode-layer 5 and insulating layer 6 are sequentially stacked on luminescent layer 3, then the EL lamp is formed (not shown).

In the method of manufacturing the EL lamp of this embodiment, after luminescent layer 3 is formed, phosphor particles 3B sink in synthetic resin layer 3A by heating and pressing layer 3. As a result, because each phosphor particle 3B uniformly disperses in synthetic resin layer 3A, a uniform EL lamp with high brightness is obtainable.

Process of manufacturing luminescent layer 3 without heating and pressing is described as follows. Dielectric layer 4 is formed by coating and drying paste of a high dielectric constant which is similar to that of synthetic resin layer 3A, where the paste includes organic solvent which dissolves or swells synthetic resin layer 3A. In such a case, phosphor particles 3B can disperse in synthetic resin layer 3A uniformly without heating and pressing layer 3.

In the process of coating paste of the high dielectric constant, the solvent in dielectric layer 4 dissolves or swells synthetic resin layer 3A, and softens layer 3A. Then phosphor particles 3B sink in synthetic resin layer 3A due to surface tension of dielectric layer 4 in a drying process. As a result, phosphor particles 3B can disperse in synthetic resin layer 3A uniformly.

When a thickness of synthetic resin layer 3A is not less than 0.01 $\mu$m and not more than 50 $\mu$m, synthetic resin layer 3A has enough adhesion to stick phosphor particle 3B. The EL lamp having high brightness can be thus manufactured. Cyanoethyl pullulan, e.g., CR-M manufactured by Shin-Etsu Chemical Co., Ltd. or Daieru G201 manufactured by Daikin Industries, Ltd., is used as synthetic resin layer 3A. In such a case, when a thickness of layer 3A is less than 0.01 $\mu$m, layer 3A has not enough adhesion, so that phosphor particles 3B occasionally come off, and when a thickness of layer 3A is more than 50 $\mu$m, brightness of the EL lamp occasionally decreases. More desirable thickness of synthetic resin layer 3A is 2 $\mu$m through 25 $\mu$m.

A phosphor-particle-dispersing apparatus used for manufacturing the EL lamp in accordance with the third embodiment is described hereinafter with reference to FIG. 4.

Figure 4:
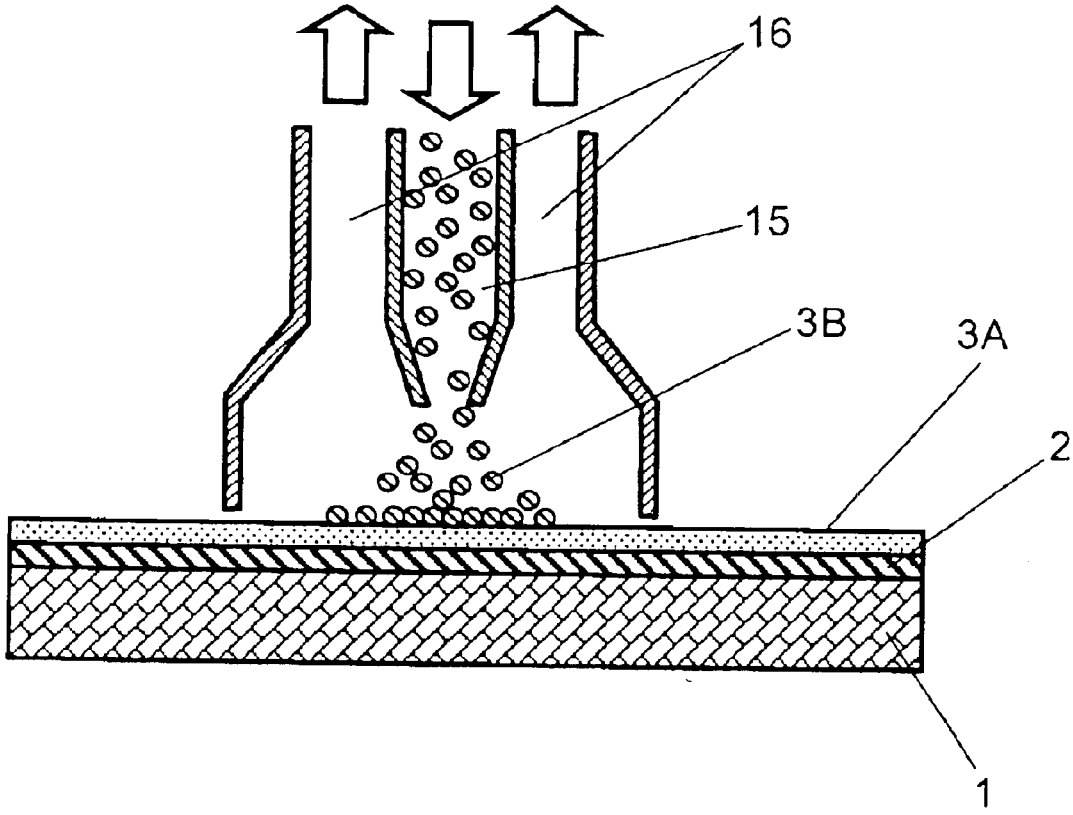
FIG. 4 shows a sectional view of an essential part of a phosphor-particle-dispersing apparatus in accordance with the third exemplary embodiment of the present invention.

FIG. 4 shows a sectional view of an essential part of the phosphor-particle-dispersing apparatus in accordance with the third exemplary embodiment of the present invention.

In FIG. 4, the phosphor-particle-dispersing apparatus includes sucking nozzle 16 surrounding blowing nozzle 15. However, sucking nozzle 16 is not necessarily placed surrounding blowing nozzle 15, but it can be placed next to blowing nozzle 15. Transparent substrate 1, on which light-transmitting electrode-layer 2 and adhesive synthetic resin layer 3A are piled up, is disposed under nozzle 15 and nozzle 16.

Phosphor particles 3B are continuously blown to a surface of synthetic resin layer 3A with heated air at approximately 50° C. through 180° C. from blowing nozzle 15. Synthetic resin layer 3A obtains enough adhesion by the heated air, so that blown phosphor particles 3B are fixed on the surface of synthetic resin layer 3A uniformly. However, an area, where phosphor particles 3B are not fixed on a surface of synthetic resin layer 3A, may occur at first. Even in such a case, phosphor particles 3B, which include various sizes of particles, are continuously blown to layer 3A, so that phosphor particles 3B having appropriate sizes are fixed on the area, phosphor particles 3B are thus fixed on a whole surface of synthetic resin layer 3A uniformly.

When phosphor particles 3B are blown, air is sucked from sucking nozzle 16, so that phosphor particles 3B not fixed on the surface of synthetic resin layer 3A are removed.

When sucking power of sucking nozzle 16 is greater than blowing power of blowing nozzle 15, dispersion of particles 3B to an undesirable area can be prevented, and particles 3B dispersed by static electricity on an area, where layer 3A is not formed, can be removed.

Then synthetic resin layer 3A is heated and pressed, luminescent layer 3 having layer 3A,where phosphor particles 3B are dispersed uniformly, is formed. When the paste having a high dielectric constant and including solvent which dissolves or swells synthetic resin layer 3A is used, a heating and a pressing processes are not necessary. In such a case, when dielectric layer 4 is formed on luminescent layer 3, phosphor particles 3B can sunk in synthetic resin layer 3A.

Finally, dielectric layer 4, back electrode-layer 5 and insulating layer 6 are sequentially stacked on luminescent layer 3, the EL lamp is thus formed.

As shown in FIG. 4, in the phosphor-particle-dispersing apparatus of this invention, phosphor particles 3B continuously disperse on the surface of synthetic resin layer 3A, then phosphor particles 3B not fixed on the surface of synthetic resin layer 3A can be removed by sucking nozzle 16. As a result, the phosphor particles can be uniformly dispersed and filled on the surface of synthetic resin layer 3A, and dispersion of the phosphor particles to an undesirable area can be prevented.

Figure 5:
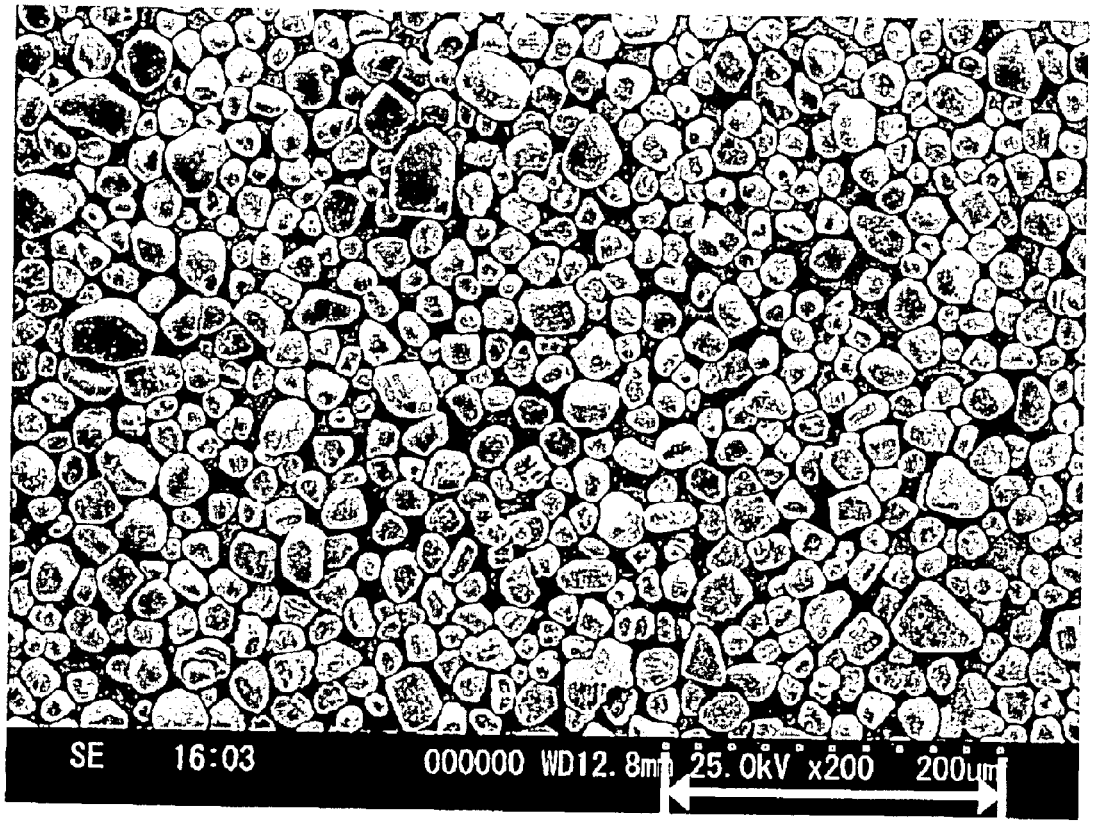
FIG. 5 shows a scanning electron microscope (SEM) photograph of a surface of a luminescent layer included in the EL lamp in accordance with the first embodiment through the third embodiment of the present invention.
Figure 6:
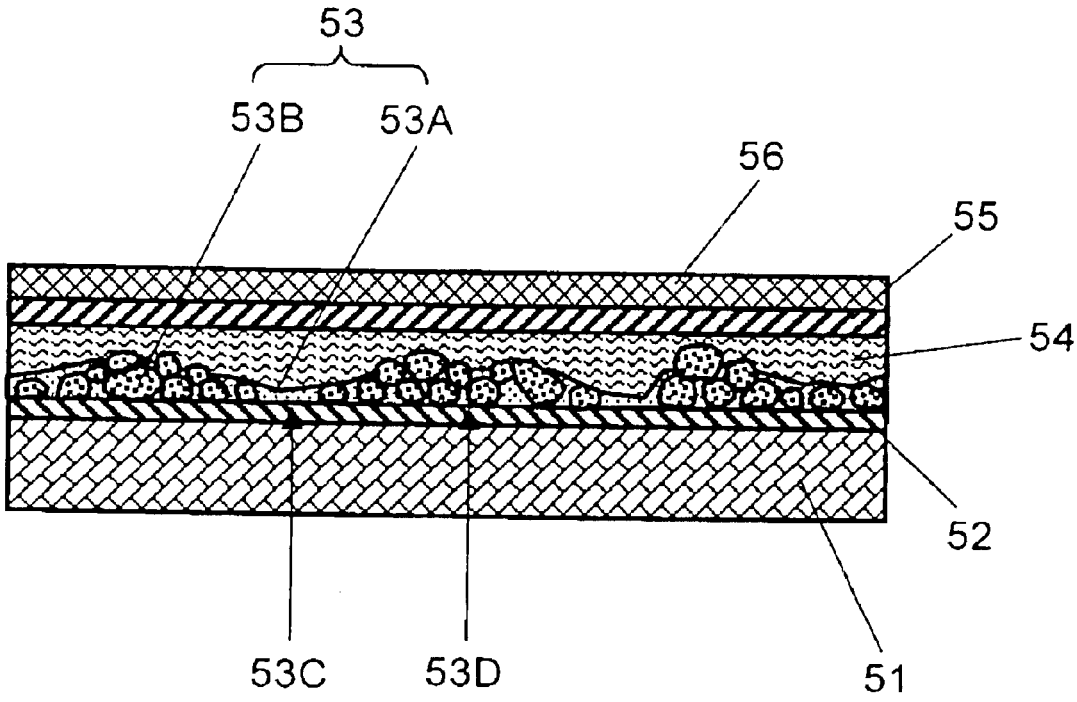
FIG.6 PRIOR ART
FIG. 6 shows a sectional view of an essential part of a conventional EL lamp.

FIG. 5 shows a scanning electron microscope (SEM) photograph of a surface of a luminescent layer included in the EL lamp in accordance with the first embodiment through the third embodiment of the present invention. As shown in FIG. 5, in the EL lamp of this invention, small phosphor particles are filled among large phosphor particles. An area, on which phosphor particles do not disperse or pile up, is not observed in the luminescent layer included in the EL lamp of this invention.

What is claimed is:

1. The method for manufacturing an EL lamp comprising the steps of:

(a) forming a light-transmitting electrode-layer on a transparent substrate;

(b) forming an adhesive synthetic resin layer on the light-transmitting electrode layer;

(c) forming a luminescent layer by:

(i) dispersing phosphor particles on the resin layer, (ii) heating the synthetic resin layer, and (iii) pressing the phosphor particles such that the phosphor particles sink into the resin layer;

(d) forming a dielectric layer on the luminescent layer; and (e) forming a back electrode-layer on the dielectric layer.

2. The method for manufacturing the EL lamp of claim 1, wherein the synthetic resin layer is not adhesive at a room temperature, and gains adhesion by heating the synthetic resin layer.

3. The method for manufacturing the EL lamp of claim 1, wherein a diameter of one of the phosphor particles is greater than a thickness of the synthetic resin layer.

4. The method for manufacturing the EL lamp of claim 1, wherein a thickness of the synthetic resin layer is not less than 0.01 $\mu$m and not more than 50 $\mu$m.

5. The method for manufacturing the EL lamp of claim 1, wherein a diameter of one of the phosphor particles is not less than 25 $\mu$m and not more than 90 $\mu$m.

6. The method for manufacturing an EL lamp comprising the steps of:

(a) forming a light-transmitting electrode-layer on a transparent substrate;

(b) forming a synthetic resin layer on the light-transmitting electrode layer;

(c) forming a luminescent layer by sticking phosphor particles on the surface of the resin layer;

(d) forming a dielectric layer on the luminescent layer by coating and drying paste of a high dielectric constant, and solvent which one of dissolves and swells the synthetic resin layer is used as organic solvent included in the paste of a high dielectric constant; and (e) forming a back electrode-layer on the dielectric layer.

7. The method for manufacturing an EL lamp comprising the steps of:

(a) forming a light-transmitting electrode-layer on a transparent substrate;

(b) forming an adhesive synthetic resin layer on the light-transmitting electrode layer;

(c) forming a luminescent layer by:

(i) dispersing phosphor particles on the resin layer, and (ii) heating and pressing the synthetic resin layer such that the phosphor particles sink into the resin layer;

(d) forming a dielectric layer on the luminescent layer; and (e) forming a back electrode-layer on the dielectric layer, wherein in step (c), after the phosphor particles are dispersed by blowing a surface of the synthetic resin layer with heated air, the phosphor particles not fixed on the surface of the synthetic resin layer are removed by a sucking nozzle.

8. The method for manufacturing an EL lamp comprising the steps of:

(a) forming a light-transmitting electrode layer on a transparent substrate;

(b) forming an adhesive synthetic resin layer on the light-transmitting electrode layer;

(c) forming a luminescent layer by blowing phosphor particles to a surface of the synthetic resin layer with heated air and removing the phosphor particles not fixed on the surface of the synthetic resin by a sucking nozzle;

(d) forming a dielectric layer on the luminescent layer; and (e) forming a back electrode-layer on the dielectric layer.

9. The method for manufacturing the EL lamp of claim 8, wherein the synthetic resin layer is not adhesive at a room temperature and gain adhesion by heating the synthetic resin layer.

10. The method of manufacturing an EL lamp comprising the steps of:

(a) forming a light-transmitting electrode-layer on a transparent substrate;

(b) forming an adhesive synthetic resin layer on the light-transmitting electrode layer;

(c) forming a luminescent layer by:

(i) dispersing phosphor particles on the resin layer, and (ii) heating and pressing the synthetic resin layer such that the phosphor particles sink into the resin layer;

(d) forming a dielectric layer on the luminescent layer; and (e) forming a back electrode-layer on the dielectric layer.

wherein in step (c), removing the phosphor particles not fixed on the surface of synthetic resin layer before heating and pressing the synthetic resin layer.

11. The method of manufacturing the EL lamp of claim 6, wherein the step (c) includes heating and pressing the synthetic resin layer such that the phosphor particles sink into the resin layer.

* * * * *